United States Patent [19]

Janssen

[11] Patent Number: 4,512,219

[45] Date of Patent: Apr. 23, 1985

[54] TOOL FOR INSTALLING ELECTRICAL WIRE HARNESS CLAMPS AND THE LIKE

[75] Inventor: Caleb E. Janssen, Orange Park, Fla.

[73] Assignee: Lockheed Corporation, Burbank, Calif.

[21] Appl. No.: 559,618

[22] Filed: Dec. 8, 1983

[51] Int. Cl.[3] ..... B25B 13/06

[52] U.S. Cl. ..... 81/121.1; 81/180.1; 81/124.2; 81/451

[58] Field of Search ..... 81/180 R, 121 R, 451, 81/121 A

[56] References Cited

U.S. PATENT DOCUMENTS

| | | | |
|---|---|---|---|
| 1,127,236 | 2/1915 | Harbridge | 81/121 R |
| 1,424,235 | 8/1922 | Bronander | 81/121 R |
| 2,565,505 | 8/1951 | Lamb | 81/451 |
| 3,779,105 | 12/1973 | Triplett et al. | 81/121 R |

FOREIGN PATENT DOCUMENTS

| | | | |
|---|---|---|---|
| 120667 | 5/1901 | Fed. Rep. of Germany | 81/121 R |
| 2091152 | 7/1982 | United Kingdom | 81/180 R |

*Primary Examiner*—Frederick R. Schmidt
*Assistant Examiner*—J. T. Zatarga
*Attorney, Agent, or Firm*—Louis L. Dachs

[57] ABSTRACT

The invention is a tool 50 for a clamp assembly used to secure wire harnesses 12 and the like to appropriate structure 14. The clamp is of the type having apertured end members 22 and 24 which are secured by means of a screw 34 and nut 46 assembly which extend through the apertures. The tool 50 comprises a guide member 52 having first and second ends with a pair of legs 56A and 56B extending from the first end in a spaced relationship. The spacing of the ends is slightly greater than the width of the ends of the clamp. The guide member 52 further incorporates an aperture 60 therethrough exiting the first end between the legs. A drive member 66 is rotatably mounted in the aperture 60 and incorporates a socket 76 facing the first end which is adapted to contain and drive the nut 46. A retaining assembly 70 and 74 is provided which is adapted to prevent the drive member from withdrawing from the aperture.

4 Claims, 5 Drawing Figures

Fig.1.
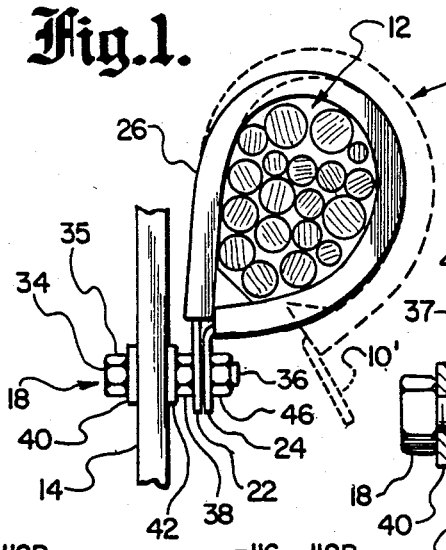
Fig.3.
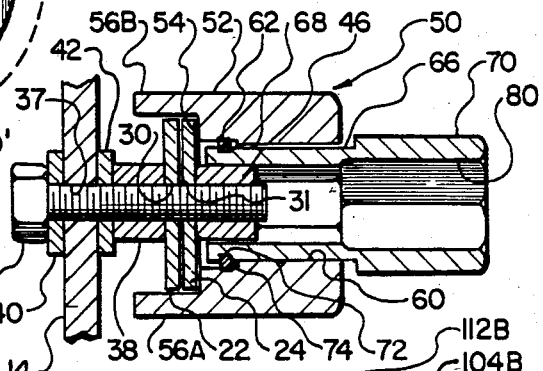
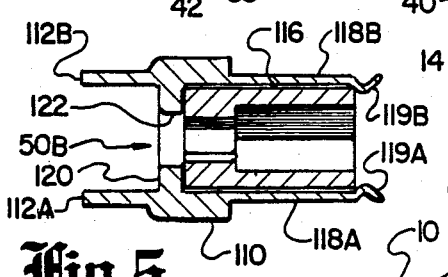
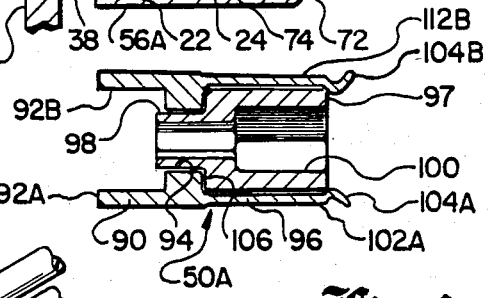
Fig.5.
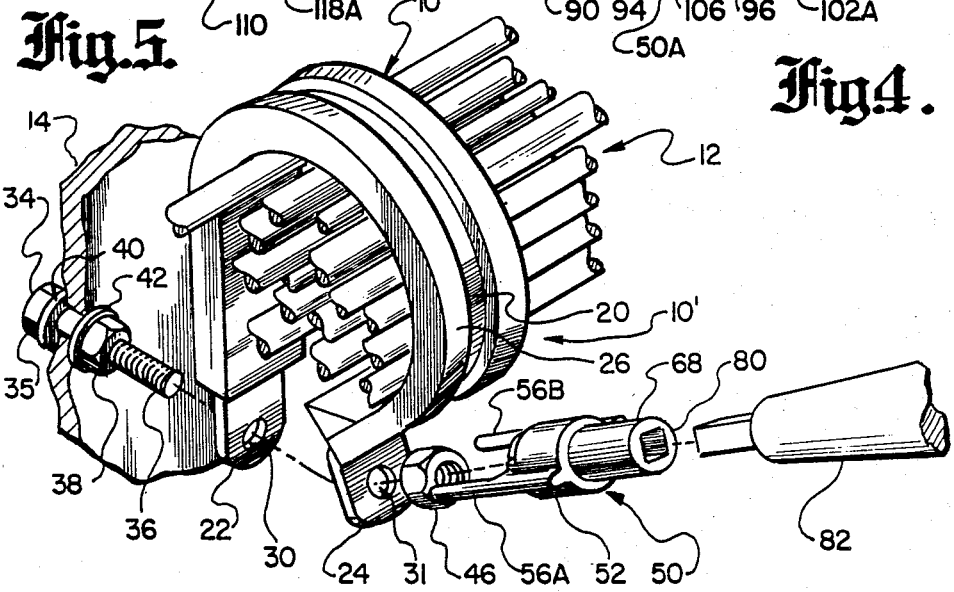
Fig.4.
Fig.2.

TOOL FOR INSTALLING ELECTRICAL WIRE HARNESS CLAMPS AND THE LIKE

TECHNICAL FIELD

The invention relates to the field of hand-operated tools and in particular an attachment for socket-wrench-type tools which aids in the installation of electrical wire harness clamps and the like.

BACKGROUND ART

Installing wire harnesses in vehicles such as aircraft using conventional clamps and the like can be difficult. In many instances the clamps will be located in confined spaces, sometimes accessible by only one hand. Additionally, the clamps are, typically, made of a spring-type material and, thus, considerable difficulty may be experienced in attempting to align and compress the ends of the clamps so that they can be fastened together using a conventional socket wrench.

If the clamp is located in an accessible area, the mechanic will normally use one hand to compress and align the ends of the clamp and the other hand to thread and tighten the nut with a socket wrench. One can readily see that if the clamp is accessible to only one hand, installation can be time consuming and frustrating.

Prior art references available to applicant have not addressed the problem of installating wire harness clamps and the like. However, U.S. Pat. No. 1,440,377, Nut Holding Member, by L. F. Crumley attacked the problem of positioning a nut so it could be secured on a shaft in a confined area. Crumley discloses a forceps-like device having arms terminating in nut retainer halves. When the two halves are drawn together a nut can be positioned therebetween. The retainer halves are slotted so that a wrench can be inserted to tighten the nut on the shaft.

In U.S. Pat. No. 2,805,594, Nut-Holding Socket Wrench by A. Fogel, a conventional socket wrench is modified by the incorporation of a retractable retaining tab which protrudes into a slot in one wall of the socket. A nut can be installed in the socket by first withdrawing the tab from the slot and thereafter inserting the nut. Once released the tab frictionally holds the nut within the socket. This wrench has the advantage of allowing the nut to be installed using only one hand, but no means are provided to align the ends of a clamp and to force them toward each other prior to engagement with the nut.

Another patent of interest is U.S. Pat. No. 2,600,214, Adjustable Bolt-Holding Wrench by F. G. Davis. Davis discloses a C-clamp having sockets at each end of the C-member with one of these members being moveable. This sort of device allows both the nut and screw to be properly aligned with each other but it would not provide for alignment of the ends of a clamp prior to screw and nut engagement.

Other patents of interest are U.S. Pat. No. 3,793,693, Hand Tool for Installing Points, Condensors and Other Devices, by M. Levak, U.S. Pat. No. 3,731,559, Unitary Dual-Wrench Tool, by R. V. Krupke and U.S. Pat. No. 1,308,687, Spring Clip Tool by G. R. Stark.

Therefore it is a primary object of this invention to provide a tool to aid in the installation of wire harness clamps and the like.

A further object of this invention is to provide a tool that will allow the securing of the clamp and wire harness by use of only one hand.

It is another object of the subject invention to provide a tool that provides for alignment of the clamp ends and the compression of one end toward the other during the installation of the clamp prior to engaging the securing nut with the screw.

DESCRIPTION OF THE INVENTION

The invention is a tool for a clamp assembly used to secure wire harnesses and the like to appropriate structure. The clamp is of the type having apertured end members which are secured by means of a screw and nut assembly which extend through the apertures. The tool comprises a guide member having first and second ends. The guide member incorporates a pair of legs extending from the first end in spaced relationship. The spacing of the ends is slightly greater than the width of the ends of the clamp. The guide member further incorporates an aperture therethrough exiting the first end between the legs. A drive member is rotatably mounted in the aperture and incorporates a socket facing the first end which is adapted to contain and drive the nut. A retaining means is provided which is adapted to prevent the drive member from withdrawing from the aperture.

In one embodiment of the retaining means, a portion of the socket end of the drive member extends out of the first end of the guide member and that portion incorporates a circumferential groove. A snap ring is mounted in the groove, and with the opposite end of the drive member larger than the aperture, the drive member is prevented from withdrawing from the guide member.

In a second embodiment of the retaining means, the aperture in the guide means is smaller than at least a portion of the drive member, such that the drive member can not pass through the aperture. A plurality of flexible retainers are mounted on the second end of the guide member with each retainer incorporating an inwardly directed protrusion chamfered on both sides. The distance of the protrusions from the second end of the guide member is slighly greater than the portion of the drive member which can not pass through the aperture. Thus the drive member is secured to the guide member.

The novel features, which are believed to be characteristic of the invention, both as to its organization and method of operation, together with further objects and advantages thereof, will be better understood from the following description connected with the accompanying drawings in which presently preferred embodiments of the invention are illustrated by way of examples. It is to be expressly understood, however, that the drawings are for purposes of illustration and description only, and are not intended as a definition of the limits of the invention.

BRIEF DESCRIPTION OF THE DRAWINGS

Illustrated in FIG. 1 is a cross-sectional view of a wire harness clamp mounted to a stand-off support.

Illustrated in FIG. 2 is a perspective view of an unsecured wire harness clamp with the tool in position to secure the clamp to a stand-off type mount.

Illustrated in FIG. 3 is a cross-sectional view along the line 3—3 of FIG. 1 with the installation tool in place.

Illustrated in FIG. 4 is a cross-sectional view of a second embodiment of the tool.

Illustrated in FIG. 5 is a cross-sectional view of a third embodiment of the tool.

BEST MODE OF CARRYING OUT THE INVENTION

Referring to FIGS. 1 and 2, it can be seen that the clamp 10, containing a wire harness assembly 12, is secured to the structure 14 by means of a screw assembly 18. The clamp 10 comprises a flexible sheet-metal band 20 terminating in flat end or leg members 22 and 24. Typically, when not secured, the clamp usually has the shape as indicated by numeral 10'. A rubber cover 26 is mounted to the band 20 to protect the wire bundle 12 from possible cutting or nicking by the edges of the band 20. The end members 22 and 24 incorporate apertures 30 and 31, respectively.

The screw assembly 18 comprises a screw 34 having a hex head 35 and a threaded shank 36 extending through aperture 37 in the structure 14. The screw 34 is secured to the structure 14 by means of nut 38 and conventional lock washers 40 and 42 which are used to aid in the locking of the screw 34 to the structure 14. The screw assembly 18, as illustrated, provides a standoff for the clamp 10 from the structure 14. When mounting the clamp 10 with the wire harness 12 therein, leg members 22 and 24 are positioned so that the threaded shank 36 passes through the aperatures 30 and 31 thereafter nut 46 is used to secure the clamp thereto. This is sometimes easier said than done.

Still referring to FIGS. 1 and 2 and additionally to FIG. 3, it will be seen that the tool, generally designated by numeral 50, can greatly alleviate the problems previously outlined. The tool 50 includes a guide member 52. Extending from a first end 54 of the guide member 52 are a pair of guide legs 56A and 56B spaced from each other a distance slightly greater than the width of the end members 22 and 24 of the clamp 10. The guide member 52 incorporates an aperature 60 therethrough and contains a counterbore 62 at the first end 54.

The drive member 66 having a socket end 68 is coaxial with and rotatably mounted within the aperture 60. The rear portion 70 of the drive member 66, has a diameter larger than the aperture 60 and, thus, the drive member 66 can not physically pass through the aperture 60. The socket end 68 incorporates a groove 72 in which is mounted a snap ring 74. With the snap ring 74 installed, the drive member can not be withdrawn from the aperture 60 since the snap ring is larger in diameter than the aperture 60. The socket 76 in socket end 68 is sized to fit the nut 46. A socket 80 is provided in the rear portion 70 which is typically a square hole adapted to receive a standard driver 82.

Thus, in order to secure the clamp 10, the driver 82 is inserted into the square hole 80 and the nut 46 is inserted into the socket 76. The assembly is then positioned so that the legs 56A and 56B straddle the end member 24 until the end 54 of the guide member contacts the end member 24. Thereafter, the assembly is pushed toward the end member 22 ensuring that the thread shank 36 of the screw 34 passes through the hole 31 in the guide member 24. Further pushing will cause the legs 56A and 56B to intercept the leg member 22, thus ensuring that the leg members 22 and 24 are properly aligned and that the apertures 30 and 31 are similarly aligned. Continued application of force will cause the nut 38 to contact the threaded shank 36 of the screw 34 at which point the legs 56A and 56B extend about both the end members 22 and 24. Rotation of the driver 82 will cause the nut 46 to threadably engage the shank 36 until the nut 46 is properly tightened thereon.

One can readily see that with this tool a clamp in a difficult-to-reach area can be secured using only one hand. This is possible because the legs 56A and 56B help maintain the alignment of the end members 22 and 24 while the guide member 52 is forcing the end member 24 towards the end member 22.

Referring now to FIG. 4 it can be seen that the instant invention can be modified so as to use standard sockets. The tool, generally designated by numeral 50A, comprises a guide member 90 having a pair of legs 92A and 92B which in all respects are similar to legs 56A and 56B illustrated in FIGS. 2 and 3. The guide member has a central aperature 94 adapted to receive a standard socket 96. Socket 96 is of the type that has a necked-down portion 98 and, thus, can extend into the aperture 94. The opposite end portion 97 of the socket 96 incorporates a typical square drive socket 100. Extending from the end of the guide member 90 are a pair of spring retainers 102A and 102B (there could be a greater number) which terminate in inwardly directed chamfered protrusions 104A and 104B. The distance between the surface 106 of the guide member 90 and the protrusions 104A and 104B is greater than the length of the end portion 97 of the socket 96. Thus the socket 96 need only be pushed by protrusions 104A and 104B causing the retainers to expand and then return to their original position, locking socket 96 in place. While the retainers 102A and 102B have been shown as integral with the guide member 90 they could be attached thereto by spot welding or other joining techniques.

Illustrated in FIG. 5 is still another embodiment. In this particular configuration the tool, designated generally by numeral 50B, comprises a guide member 110 having a pair of legs 112A and 112B in spaced relationship similar to legs 56A and 56B. In this embodiment the guide member 110 is adapted to receive a standard socket 116 having a constant diameter. As before, retainers 118A and 118B are similar in design to retainers 102A and 102B illustrated in FIG. 4 having protrusions 119A and 119B chamfered on both sides. Here, in order that the drive member 116 can be positioned as close as possible to the end member 24 of the clamp 10, the flange 120 of the guide member 110 is made as thin as possible, yet still meeting structural requirements, while the aperture 122 must be large enough to pass the nut therethrough. Installation of the socket 116 in the guide member 110 is identical to the method as set forth for tool 50A.

While the invention has been described with reference to particular embodiments, it should be understood that the embodiments are merely illustrative as there are numerous variations and modifications which may be made by those skilled in the art. Thus, the invention is to be construed as being limited only by the spirit and scope of the appended claims.

INDUSTRIAL APPLICABILITY

The tool has application for installing wire harnesses and the like.

I claim:

1. An installation tool for a clamp assembly, said clamp assembly being of the type having apertured end members and being securable by means of a screw and nut assembly extending through the aperture, the tool comprising:

a guide member having first and second ends, said guide member having a pair of legs extending from said first end in mutually spaced relationship adapted to straddle the end members, said guide member further having an aperture therethrough exiting from said first end between said legs;

a drive member having at least a portion thereof greater in diameter than the diameter of said aperture, said drive member further having a socket aligned with said aperture and adapted to receive and rotate the nut; and retaining means adapted to releasably hold said drive member in alignment with said aperture, said retaining means comprising a plurality of spring retainers mounted on said second end of said guide member, each of said retainers terminating in an inwardly directed protrusion, the distance of said protrusions from said second end being slightly greater than said portion of that drive member having a diameter greater than said aperture;

such that said drive member can be installed and retained by said retaining members by inserting said drive member past said protrusions, causing said retainers to yield and thereafter return to their original position, securing said drive member to said guide member.

2. The tool as set forth in claim 1 wherein the opposite end of said drive member incorporates a socket adapted to receive a standard driver tool.

3. An installation tool for a clamp assembly, said clamp assembly of the type having apertured end members and being securable by means of a screw and nut assembly extending through the aperture, the nut adapted to be driven by a standard socket-type drive member, the tool comprising:

a guide member having first and second ends, said guide member having a pair of legs extending from said first end in mutually spaced relationship adapted to straddle the end members, said guide member further having an aperture therethrough exiting from said first end between said legs; and retaining means adapted to releasably hold the drive member in alignment with said aperture, said retaining means comprising a plurality of spring retainers mounted on said second end of said guide member, each of said retainers terminating in an inwardly directed protrusion;

such that the drive member can be installed and retained by said retaining members by inserting the drive member past said protrusions, causing said retainers to yield and thereafter return to their original position, securing the drive member to said guide member.

4. The tool as set forth in claim 3 wherein said drive member having a portion theof adapted to rotatably mount within said aperture.

* * * * *